US006530237B2

(12) United States Patent
Morse et al.

(10) Patent No.: US 6,530,237 B2
(45) Date of Patent: Mar. 11, 2003

(54) REFRIGERATION SYSTEM PRESSURE CONTROL USING A GAS VOLUME

(75) Inventors: Douglas H. Morse, Millis, MA (US); James A. O'Neil, Bedford, MA (US)

(73) Assignee: Helix Technology Corporation, Mansfield, MA (US)

( * ) Notice: Subject to any disclaimer, the term of this patent is extended or adjusted under 35 U.S.C. 154(b) by 0 days.

(21) Appl. No.: 09/824,530

(22) Filed: Apr. 2, 2001

(65) Prior Publication Data

US 2002/0139129 A1 Oct. 3, 2002

(51) Int. Cl.[7] ..... F25B 45/00
(52) U.S. Cl. ..... 62/149; 62/228.3
(58) Field of Search ..... 62/149, 115, 228.3, 62/174, 175

(56) References Cited

U.S. PATENT DOCUMENTS

| | | | | |
|---|---|---|---|---|
| 3,827,241 A | | 8/1974 | Almstrom et al. | 60/521 |
| 3,859,166 A | | 1/1975 | Flynn et al. | 176/38 |
| 3,964,866 A | | 6/1976 | Shelby | 23/252 |
| 3,990,246 A | | 11/1976 | Wilmers | 60/707 |
| 4,346,563 A | | 8/1982 | Hood | 62/117 |
| 4,559,786 A | | 12/1985 | Schuck | 62/55 |
| 4,601,171 A | | 7/1986 | Stotts | 60/521 |
| 4,693,736 A | | 9/1987 | Klusmier | 62/6 |
| 4,718,442 A | | 1/1988 | Nicoll | 137/1 |
| 4,897,022 A | | 1/1990 | Hudson | 417/7 |
| 4,918,930 A | | 4/1990 | Gaudet et al. | 62/55.5 |
| 5,092,745 A | | 3/1992 | Graham | 417/401 |
| 5,136,851 A | * | 8/1992 | Kotaka | 62/468 |
| 5,137,050 A | | 8/1992 | Clarke et al. | 137/541 |
| 5,189,885 A | | 3/1993 | Ni | 62/117 |
| 5,242,277 A | | 9/1993 | Bartlett | 417/307 |
| 5,259,204 A | * | 11/1993 | McKeown | 62/174 |
| 5,317,878 A | | 6/1994 | Bradshaw et al. | 62/6 |
| 5,319,945 A | | 6/1994 | Bartlett | 62/174 |
| 5,408,840 A | | 4/1995 | Talley | 62/126 |
| 5,551,488 A | | 9/1996 | Gram | 141/18 |
| 5,586,443 A | | 12/1996 | Lewis | 62/115 |
| 5,660,530 A | | 8/1997 | Rafei | 417/125 |
| 5,685,159 A | | 11/1997 | Kooy et al. | 62/50.1 |
| 5,797,262 A | | 8/1998 | Omoto | 60/410 |

FOREIGN PATENT DOCUMENTS

| | | |
|---|---|---|
| GB | 2 084 306 A | 4/1982 |
| JP | 60132052 | 7/1985 |
| JP | 04136664 | 5/1992 |
| JP | 11281181 | 10/1999 |
| JP | 11281182 | 10/1999 |
| JP | 2001074326 | 3/2001 |
| WO | WO 91/15672 | 10/1991 |

* cited by examiner

*Primary Examiner*—Chen-Wen Jiang
(74) *Attorney, Agent, or Firm*—Hamilton, Brook, Smith & Reynolds, P.C.

(57) ABSTRACT

An apparatus and method are provided for controlling a system pressure in a refrigeration system based on a variable load, which includes sensing return pressure and high side pressure in the system, and adjusting the low pressure to optimize a gas flow rate in the system by adding or removing gas from the system through an operating range of pressures in response to the sensed return pressure and the sensed high side pressure. The method further includes calculating a pressure difference between the return pressure and the high side pressure. A second pressure difference is calculated, and if the pressure difference decreases, gas is added to system and if the pressure difference increases, gas is removed from the system.

22 Claims, 4 Drawing Sheets

REFRIGERATION SYSTEM PRESSURE CONTROL USING A GAS VOLUME

BACKGROUND OF THE INVENTION

In a typical compressor for a cryogenic refrigerator, helium returns from a cryogenic refrigerator to a compressor pump via a helium return line. Oil is injected into the helium at the inlet to the compressor. The oil absorbs the heat of compression given off by the helium. The combined mixture of helium and oil is pumped from the compressor through a line to a heat exchanger where the heat contained in the mixture is given off. The helium and oil mixture is then pumped to a bulk oil separator which separates the helium from the oil and the oil returns via a line back to the compressor. The helium travels from the separator to an oil mist separator where any residual oil mist is separated from the helium.

The helium travels from the oil mist separator to an adsorber which further removes any remaining impurities from the helium. From the adsorber, the helium is then pumped via a helium supply line to the cold head of a cryogenic refrigerator such as a Gifford-McMahon cryogenic refrigerator, where it expands to a lower pressure. The lower pressure helium travels returns via the helium return line back to the compressor where the cycle is again repeated.

An additional helium line lies between the helium supply line and the helium return line. Situated within this line is a differential-pressure relief or by-pass valve. Any excess pressure which may build up in the helium supply line to the cryogenic refrigerator can be released through this line and valve and shunted to the helium return line valve. The relief valve automatically opens and allows helium to travel from the supply line to the return line when the pressure difference between the helium supply line and the helium return line reaches a given predetermined pre-set pressure. The setting on the by-pass valve is determined by the maximum pressure difference at which the compressor pump can operate under worst case conditions (for example, voltage, ambient, water temperature, and flow rate).

With the use of larger cryogenic refrigerator systems used in the field of manufacturing of semiconductors, for example, it is desirable to match the system demand, which often varies depending on the load, with the compressor output to optimize efficiency of the system. It has been shown that raising the operating pressure in the system can increase efficiency of a Gifford-McMahon refrigeration system. When a system was charged at the high pressure level, the setting on the bypass valve had to be reduced from 235 psi to 210 psi to prevent overheating the compressor motor.

FIG. 1 depicts the compressor operating at low pressure. The y axis on the left hand side of the graph measures the flow rate of gas through the compressor illustrated by line 2. The x axis measures the pressure differential between the low and high side pressures in the system. The y axis on the right hand side measures power in watts that the compressor consumes illustrated by line 4. The bypass valve in this embodiment is not fully closed until about 200 psi differential or below. FIG. 2 is similar to FIG. 1 but depicts the compressor operating at high pressure in which the flow rate is substantially greater than at low pressure. Because the bypass valve is set at about 210 psi, the valve does not close fully until the pressure differential falls below about 180 psi.

SUMMARY OF THE INVENTION

In accordance with the present invention, a method is provided for controlling a system pressure in a refrigeration system based on a variable load, which includes sensing return pressure and high side pressure in the system, and adjusting the return pressure to optimize a gas flow rate in the system by adding or removing gas from the system through an operating range of pressures in response to the sensed return pressure and the sensed high side pressure. The method can further include calculating a pressure difference between the return pressure and the high side pressure.

A second pressure difference can be calculated, and if the pressure difference decreases, gas is added to system and if the pressure difference increases, gas is removed from the system.

In alternative embodiments, the pressure difference between the return pressure and the high side pressure can be sensed, for example, with a differential pressure gauge. The low pressure can be adjusted to optimize the gas flow rate in the system by adding or removing gas from the system through the operating range of pressures in response to the sensed return or high side pressure and the sensed pressure difference.

An apparatus is also provided for optimizing a gas flow rate in a refrigeration system, comprising a compressor pump for compressing a gas, and at least one cold head that receives the compressed gas from a supply line and allows the gas to expand and to be returned to the compressor pump by a return line. The apparatus further includes a gas volume disposed between the supply line and return line for adding or removing gas from the system to optimize the flow rate of the gas in the system through an operating range of pressures in response to sensed pressures in the supply line and return line. In one embodiment, the refrigeration system is a cryogenic refrigeration system and the gas includes helium.

A first valve can be disposed on a high pressure side of the gas volume and a second valve can be disposed on a low pressure side of the gas volume for controlling the flow rate of the gas in the system. A first sensing device can be disposed on the high pressure side of the gas volume for sensing a supply pressure and a second sensing device can be disposed on the low pressure side of the gas volume for sensing a return pressure. A controller can be coupled to the sensing devices for receiving the supply pressure and return pressure and calculating the pressure difference.

A first actuator can be coupled to the first valve for opening and closing the same and a second actuator can be coupled to the second valve for opening and closing the same in response to commands from the controller. If the pressure difference decreases, the controller directs the first actuator to close the first valve and directs the second actuator to open the second valve to allow gas to enter the system. If the pressure difference increases, the controller directs the first actuator to open the first valve and directs the second actuator to close the second valve to allow gas to be removed from the system.

The benefits of the present invention are illustrated in FIG. 3. As system demand decreases, that is, less flow is demanded of the compressor by the cryopumps, power is reduced dramatically, for example, from about 6000 watts to about 4600 watts at a 0 SCFM (standard cubic feet per minute) flow rate. Further, the compressor is capable of providing full output, i.e., the bypass valve is fully closed, at a high pressure differential (200 psi vs. 180 psi). Generally, the invention allows the system to operate at both high and low pressures and every pressure in between, and controls this operation based on demand of the cryopumps.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 4:
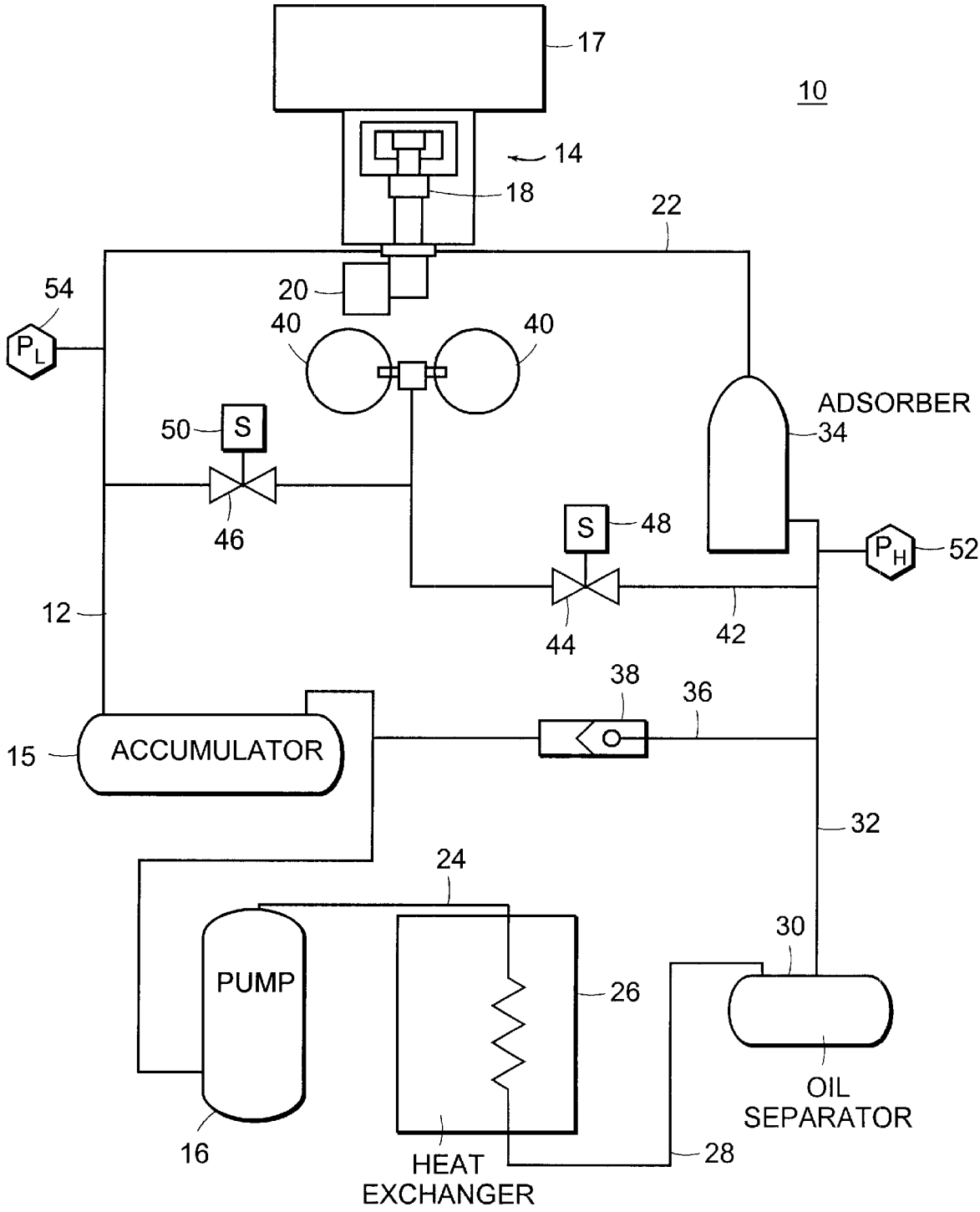
FIG. 4 is a schematic of an embodiment of a cryogenic refrigerator compressor unit in accordance with the present invention.

A description of preferred embodiments of the invention follows. FIG. 4 illustrates a cryogenic refrigerator compressor unit 10. It shows a helium return line 12 which carries returning helium from a cryogenic refrigerator in a cryopump 14 to a compressor pump 16 after passing through an accumulator 15 which provides a buffer between the refrigerator and pump. An example of the cryopump 14 is illustrated in U.S. Pat. No. 4,918,930 issued to Gaudet et al. on Apr. 24, 1990, the contents of which are incorporated herein by reference. In one embodiment, a two stage displacer in a two stage refrigerator cold finger or head 18 is driven by a motor 20 to cool a device 17. With each cycle, helium gas introduced into the cold head 18 under pressure through line 22 is expanded and thus cooled and then exhausted through line 12.

Oil is injected into the helium at the inlet to compressor pump 16 and the oil absorbs the heat of compression of the helium as the helium is being compressed by the compressor pump. The helium-oil mixture is then pumped through line 24 to and through heat exchanger 26. The helium and oil mixture passes from heat exchanger 26 through line 28 to bulk-oil separator 30. Separated oil can be returned to the compressor pump 16 or to the sump of the compressor as disclosed in U.S. Pat. No. 4,718,442, the contents of which are incorporated herein by reference.

The helium flows from the bulk-oil separator 30 through supply line 32 to an adsorber 34 which further filters the helium. The helium then travels to the cryogenic refrigerator 14 via line 22.

Between the helium return line 12 and helium supply line 32 is line 36. Within line 36 is an in-line, externally adjustable, differential pressure relief valve 38. When the pressure of the helium within the supply line 32 reaches a certain point beyond the pressure necessary to overcome the bias against the valve, the valve opens to allow helium to flow from the helium supply line to the helium return line 12 and thus regulate the pressure of the supply line. The relief valve 38 is designed such that the pressure setting of the valve can be set externally. See, for example, U.S. Pat. No. 4,718,442, which is incorporated herein by reference. Thus, a closed loop system is provided.

In accordance with the present invention, an intermediate gas volume stores and releases helium to raise and lower the operating pressure of the system as a whole in response to the demand by the refrigerator 14. It is known that the demand of the cold head(s) is directly related to the pressure difference between the supply pressure and return pressure in the system.

A second line 42 connects the supply line 32 with the return line 12. A first inline valve 44 and a second in-line valve 46 are disposed within line 42. One or more storage tanks 40 are disposed between the valves 44 and 46. Solenoids or actuators 48 and 50 are respectively coupled to valves 44 and 46 to open and close the same.

Figure 1:
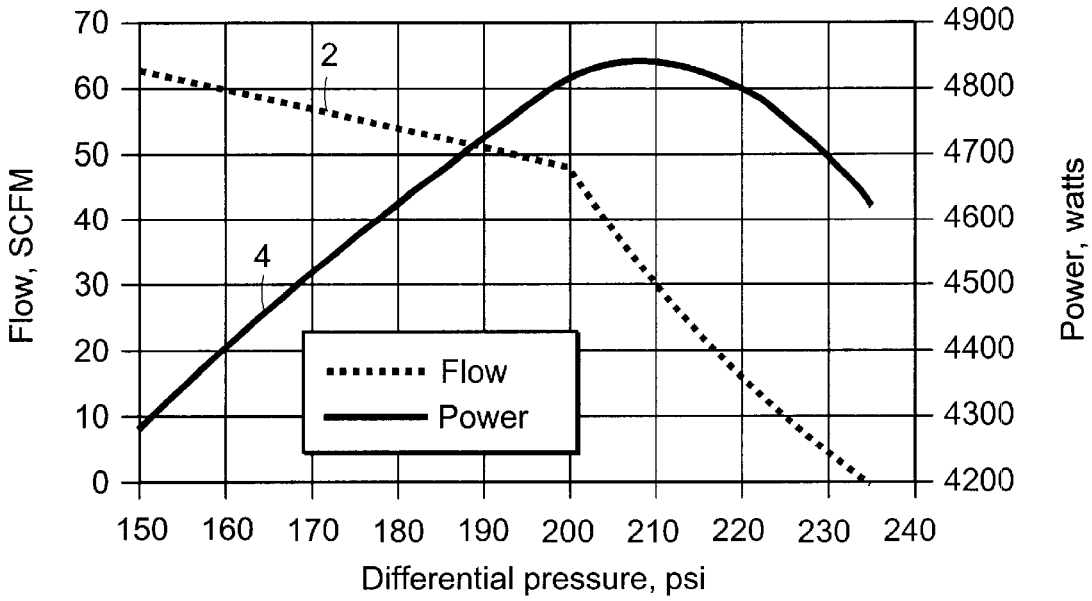
FIG. 1 PRIOR ART
FIG. 1 is a graph illustrating a compressor of a refrigeration system operating at low pressure in accordance with the prior art.
Figure 2:
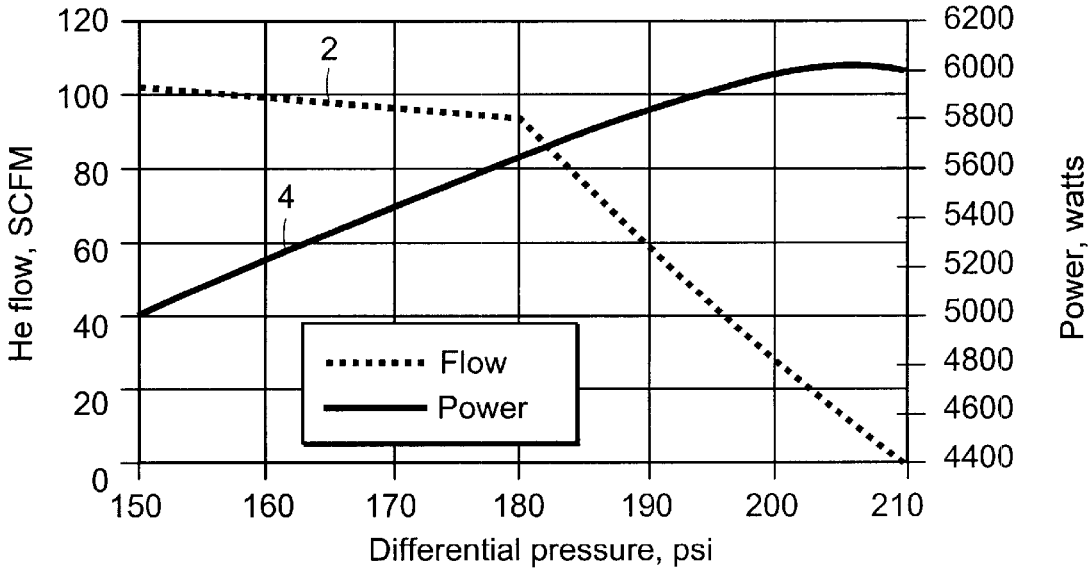
FIG. 2 PRIOR ART
FIG. 2 is a graph illustrating a compressor of a refrigeration system operating at high pressure in accordance with the prior art.
Figure 3:
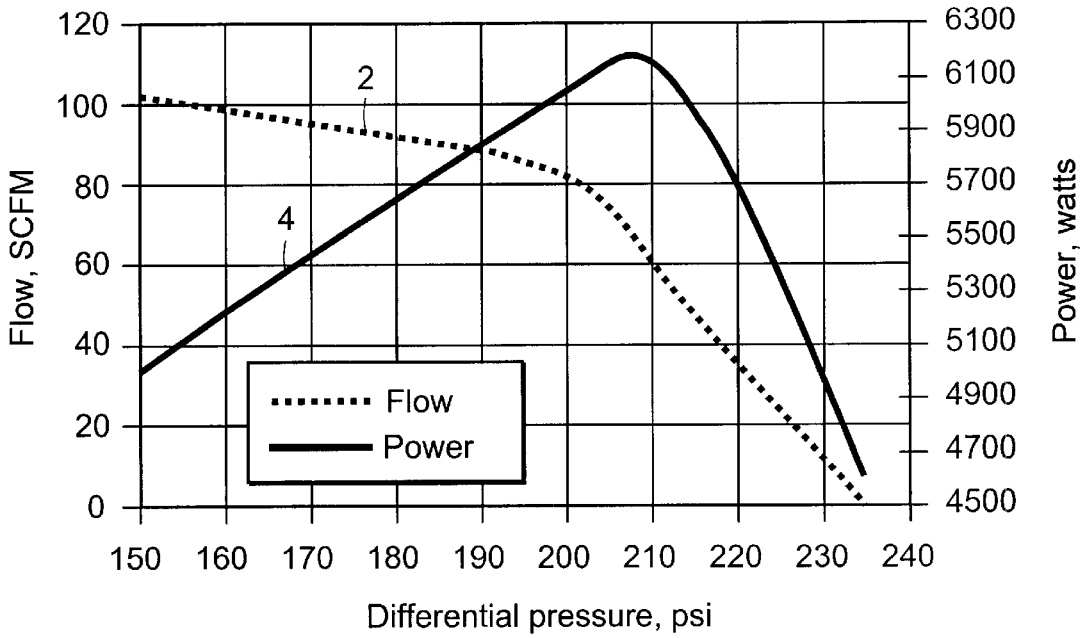
FIG. 3 is a graph illustrating a compressor operating in accordance with the present invention.
Figure 5:
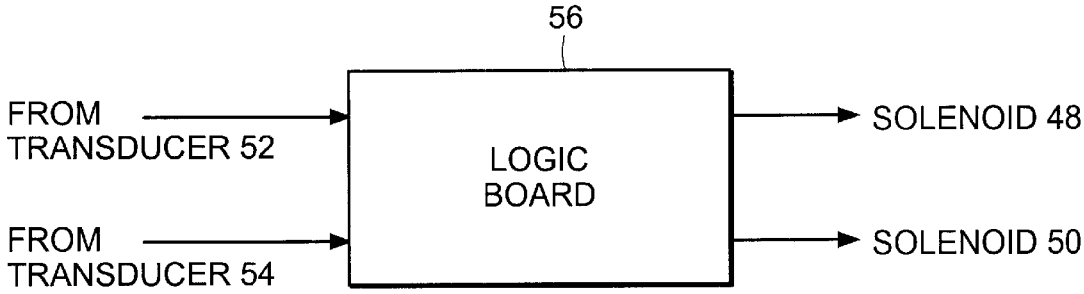
FIG. 5 is a schematic of a control scheme used to control solenoids shown in FIG. 1.

A pressure transducer or sensor 52 is coupled to the supply line 32 to measure the pressure within the line. Similarly, a pressure transducer or sensor 54 is coupled to the return line 12 to measure the pressure within that line. In alternative embodiments, a differential pressure gauge can be provided to measure the pressure difference between the return line 13 and the supply line 32. As shown in FIG. 5, the signal from these sensors is read by a logic board or controller 56, which calculates the pressure difference between the supply line 32 pressure and return line 12 pressure. The logic board 56 has a control algorithm which calculates the desired return line pressure in the system as a function of the pressure difference, and opens and closes valves 44 and 46 via respective solenoids 48 and 50.

Figure 6:
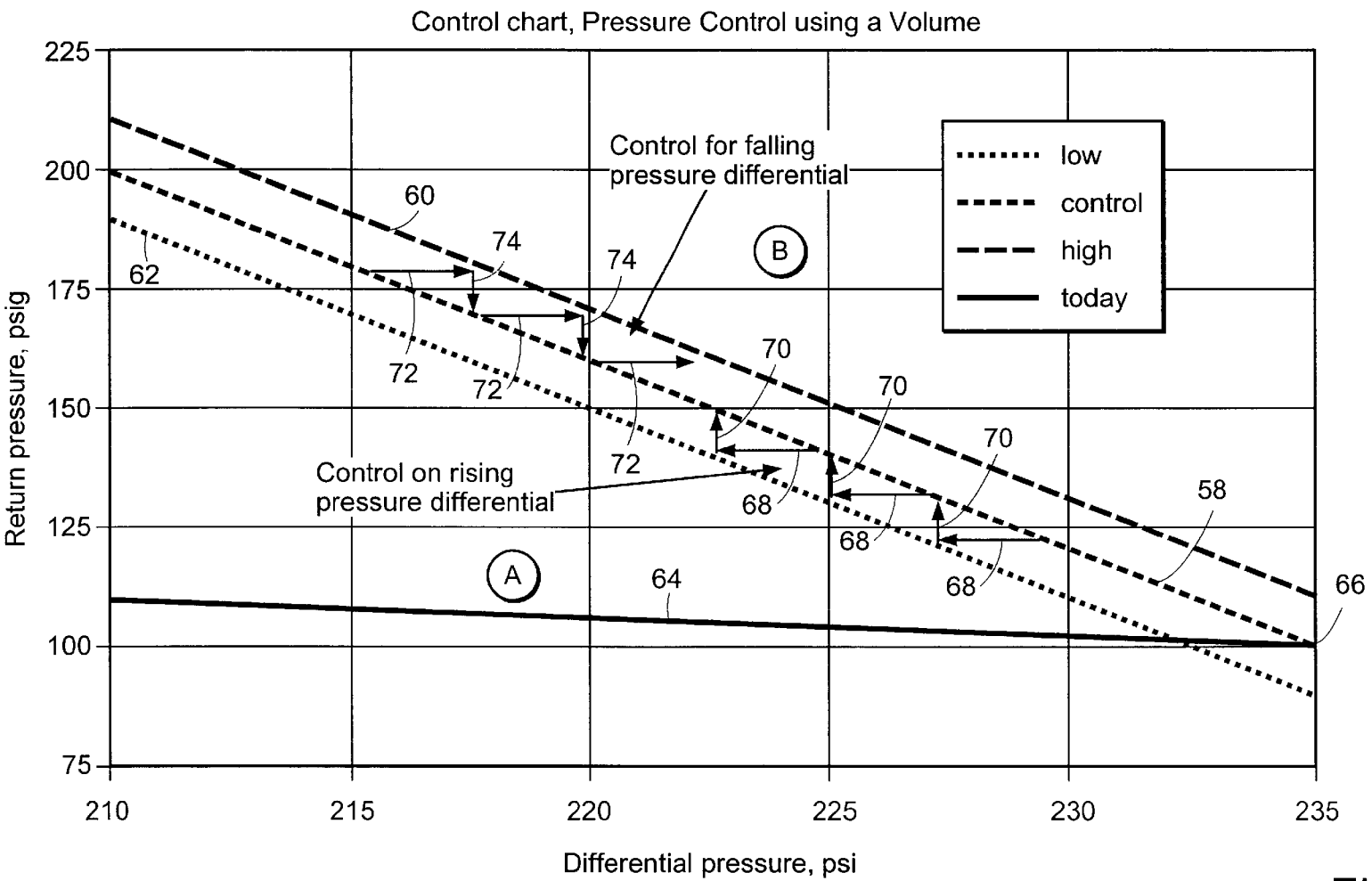
FIG. 6 is a control chart illustrating the inventive principles of the present invention.

FIG. 6 is a control chart further in accordance with the present invention in which the return line pressure is measured on the y axis and the pressure difference between the supply line pressure and return line pressure is measured on the x axis. Generally, the idea is to balance the demand of the compressor pump with the demand of the cold head(s). The area below line 62, labeled area "A", is better suited for the compressor in that the pressure is relatively low. However, the cold heads are not as efficient as they could be because the pressure is low. Conversely, in the area above line 60, labeled area "B", the compressor is straining due to the high pressure while the cold heads operate more efficiently than in area "A".

Prior art systems maintain the return pressure well below line 62 to keep the compressor from overworking as, for example, illustrated by line 64. However, this prevents the cold heads from operating as efficiently as they otherwise could. Thus, prior art systems have been unable to effectively balance the demand of the compressor with the demand of the cold heads at varying pressure differences.

In accordance with one aspect of the present invention, the return pressure (y axis) is controlled based on the pressure difference (x axis) between the return line pressure and supply line pressure to stay within the area defined by lines 60 and 62, and preferably along control line 58. For example, at point 66, the return line pressure is about 100 psig while the pressure differential is about 235 psi. This is a preferable location as the compressor pump is not straining and there is a high pressure difference such that the cold head operates most efficiently. The by-pass valve 38 can be set at 235 psi and be used for emergency purposes. If the pressure difference begins to fall, for example, following line 68, this is indicative that the cold head is demanding more gas than the compressor pump can provide. Thus, more gas is added to the system by opening valve 46 and closing valve 44 which raises the system pressure as indicated by line 70.

Conversely, if the pressure difference is increasing, for example, following line 72, this is indicative that the cold head has sufficient gas and therefore valve 44 is opened while valve 46 is closed. This allows gas to be stored in tanks 40 to reduce the system pressure as indicated by line 74. Thus, the pressure difference is decreased to improve efficiency of the system by decreasing the load on the compressor pump. This approach has advantages over an improved mechanical control, and even an electronic control valve in that it allows a higher pressure difference between the supply line and the return line at part-load condition to improve cool down times of the cold head. The controls are easier to execute than by an electronic by-pass valve because, under dynamic conditions, the compressor can operate for up to a minute at the full setting of the by-pass valve even at maximum return line pressure. By making both valves 44, 46 normally open, they act as pressure equalization valves during shut down, eliminating the need for a by-pass valve. However, a by-pass valve is preferably left in the system for emergency purposes.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of controlling a system pressure in a refrigeration system based on a variable load, comprising:

sensing return pressure and high side pressure in the system; and adjusting the return pressure to optimize a gas flow rate in the system by adding or removing gas from the system through an operating range of pressures in response to the sensed return pressure and the sensed high side pressure.

2. The method of claim 1, further comprising calculating a pressure difference between the return pressure and the high side pressure.

3. The method of claim 2, further comprising calculating a second pressure difference, wherein if the pressure difference decreases, gas is added to system.

4. The method of claim 2, further comprising calculating a second pressure difference, wherein if the pressure difference increases, gas is removed from the system.

5. The method of claim 1, further comprising providing a gas volume in the system and adjusting the return pressure in the refrigeration system by adding or removing gas from the gas volume.

6. The method of claim 5, further comprising calculating a second pressure difference, wherein if the pressure difference decreases, gas is added to system.

7. The method of claim 5, further comprising calculating a second pressure difference, wherein if the pressure difference increases, gas is removed from the system.

8. The method of claim 1, further comprising sensing a pressure difference between the return pressure and the high side pressure.

9. The method of claim 8, further comprising adjusting the return pressure to optimize the gas flow rate in the system by adding or removing gas from the system through the operating range of pressures in response to the sensed return pressure and the sensed pressure difference.

10. The method of claim 8, further comprising adjusting the return pressure to optimize the gas flow rate in the system by adding or removing gas from the system through the operating range of pressures in response to the sensed high side pressure and the sensed pressure difference.

11. A method for optimizing the flow rate of a gas in a refrigeration system, comprising:

sensing a return pressure and a high side pressure in the system;

calculating a pressure difference between the return pressure and the high side pressure; and adjusting the return pressure to optimize the flow rate in the system by adding or removing gas from the system through an operating range of pressures in response to the sensed return pressure and the sensed high side pressure.

12. The method of claim 11, further comprising calculating a second pressure difference, wherein if the pressure difference decreases, gas is added to system.

13. The method of claim 11, further comprising calculating a second pressure difference, wherein if the pressure difference increases, gas is removed from the system.

14. An apparatus for optimizing a gas flow rate in a refrigeration system, comprising:

a compressor pump for compressing a gas;

at least one cold head that receives the compressed gas from a supply line and allows the gas to expand and to be returned to the compressor pump by a return line; and a gas volume disposed between the supply line and return line for adding or removing gas from the system to optimize the flow rate of the gas in the system through an operating range of pressures in response to sensed pressures in the supply line and return line.

15. The apparatus of claim 14, wherein the refrigeration system is a cryogenic refrigeration system and the gas includes helium.

16. The apparatus of claim 14, further comprising a first valve disposed on a high pressure side of the gas volume and a second valve disposed on a low pressure side of the gas volume, the first valve and the second valve for controlling the flow rate of the gas in the system.

17. The apparatus of claim 16, further comprising a first sensing device on the high pressure side of the gas volume for sensing the supply pressure and a second sensing device on the low pressure side of the gas volume for sensing the return pressure.

18. The apparatus of claim 17, further comprising a controller for receiving the supply pressure and return pressure and calculating the pressure difference.

19. The apparatus of claim 18, further comprising a first actuator for opening and closing the first valve and a second actuator for opening and closing the second valve in response to commands from the controller.

20. The apparatus of claim 19, wherein if the pressure difference decreases, the controller directs the first actuator to close the first valve and directs the second actuator to open the second valve to allow gas to enter the system.

21. The apparatus of claim 18, wherein if the pressure difference increases, the controller directs the first actuator to open the first valve and directs the second actuator to close the second valve to allow gas to be removed from the system.

22. An apparatus for optimizing a gas flow rate in a refrigeration system, comprising:

a compressor pump for compressing a gas;

at least one cold head that receives the compressed gas from a supply line and allows the gas to expand and to be returned to the compressor pump by a return line; and means for optimizing the flow rate of the gas in the system by adding or removing gas from the system through an operating range of pressures in response to sensed pressures in the supply line and return line.

* * * * *